US006899576B2

(12) United States Patent
Reuter et al.

(10) Patent No.: US 6,899,576 B2
(45) Date of Patent: May 31, 2005

(54) TWIN-PROPELLER DRIVE FOR WATERCRAFT

(75) Inventors: Reinhold Reuter, Schwall (DE); Stefan Kaul, Harschbach (DE)

(73) Assignee: Schottel GmbH & Co. KG, Spay (DE)

( * ) Notice: Subject to any disclaimer, the term of this patent is extended or adjusted under 35 U.S.C. 154(b) by 0 days.

(21) Appl. No.: 10/715,344

(22) Filed: Nov. 17, 2003

(65) Prior Publication Data

US 2004/0147182 A1 Jul. 29, 2004

Related U.S. Application Data

(63) Continuation-in-part of application No. 09/838,704, filed on Apr. 19, 2001, now abandoned, which is a continuation-in-part of application No. 09/297,715, filed as application No. PCT/EP97/06207 on Nov. 7, 1997.

(51) Int. Cl.[7] ..... B63H 1/18
(52) U.S. Cl. ..... 440/66; 440/81
(58) Field of Search ..... 440/66, 67, 81; 114/151

(56) References Cited

U.S. PATENT DOCUMENTS 4,074,652 A 2/1978 Jackson

FOREIGN PATENT DOCUMENTS

DE 44 40 738 A1 5/1996
JP 62-261591 11/1987

*Primary Examiner*—Ed Swinehart
(74) *Attorney, Agent, or Firm*—Martin Fleit; Paul D. Bianco; Fleit Kain Gibbons Gutman Bongini & Bianco P.L.

(57) ABSTRACT

In a watercraft drive for a watercraft having front and rear propellers respectively mounted on a drive shaft in coaxial longitudinally displaced relationship, each of said propellers having at least two blades, the front and rear propellers having equal diameters and being driven at like rotational velocities. The central portion of the rear propeller up to a diameter equal to the diameter of the water jet arriving at the rear propeller, which due to the action of the front propeller has a contracted cross section, is designed to optimize the jet energy exiting the front propeller. The rear propeller has an annular area extending from the central portion to the outer circumference of the rear propeller, being designed with the same design as characterizes the front propeller. The annular area of the rear propeller receives a flow of surrounding ambient water.

26 Claims, 9 Drawing Sheets

TWIN-PROPELLER DRIVE FOR WATERCRAFT

RELATED APPLICATION

This application is a continuation-in-part of U.S. application Ser. No. 09/838,704, filed Apr. 19, 2001 now abandoned, the contents of which are here incorporated in their entirety, which is a continuation-in-part of U.S. application Ser. No. 09/297,715 filed Jun. 21, 1999, abandoned, which is a Sec. 371 of PCT/EP97/06207 filed Nov. 7, 1997.

BACKGROUND OF THE INVENTION

1. Field of the Invention

The present invention pertains to a hydrojet with a drive unit and novel twin propellers, driven by the drive unit.

2. Prior Art

Such drives are known with a design wherein the drive unit proper, for example a diesel engine, is arranged within the hull and a transmission, being another part of the drive unit, is located in a gondola under the hull, from which shafts are led out at mutually opposite ends, the shafts being connected to the transmission and, at their outer ends, to one of two propellers shown as identical propellers, rotating in unison with them. Such a solution is described in DE 44 40 738 A1, in which an essential feature is a control device, which is arranged between the two propellers and eliminates the twist in the water after it leaves the propeller that is the front propeller in the direction of travel, so that this water flows to the propeller that is the rear propeller in the direction of travel with a higher energy, but likewise without twist, as it does to the front propeller. The control device is formed by guide blades and a shaft, which connects the gondola or the underwater housing to the hull. Such a drive is also described with some additional information in *THE MOTORSHIP*, Oct. 1996, pp. 47, 48: "Double the props: half the problem."

The art further recognizes that although the propellers are of equal diameter, the geometry required for the rear propeller is different for the geometry required for the first propeller because of the water flowing to the propellers regarding pressure, flow rate, and other parameters. These geometrical requirements are well known to marine engineers and naval architects, persons skilled in the art. To design the front propeller and the different rear propeller for a particular application is readily accomplished according to known principles of marine engineering and naval architecture, and poses no problem or difficulty to those of skill in the art. Notwithstanding the foregoing, for watercraft of this type with two propellers, coaxially driven in the same sense, cavitation and other deleterious effects may occur.

SUMMARY OF THE INVENTION

Accordingly, the object of the present invention is to optimize a ship drive employing two propellers such that cavitation and other deleterious effects are avoided, and the operations are more efficient. This object is accomplished according to the present invention by providing a design for the first propeller in a conventional manner and creating a hybrid design for the second propeller. This novel hybrid design consists of designing the central portion of the propeller, having a diameter substantially equal to the contraction in flow generated by the first propeller, with the conventional design for a second propeller, and peripherally outward thereof, that is from the diameter equal to the contraction in flow, up to the tips of the blades, designing the second propeller in the conventional manner as the first propeller. The result is that only the central portion of the second propeller is designed differently from the first propeller to meet the constraints of the water flow, pressure, etc. coming out of the first propeller, and the outer, annular or peripheral portion beyond the diameter of water flow contraction produced by the wake of the first propeller at its arrival at the second propeller, being designed exactly as the first propeller.

In the drive according to the present invention, the two propellers have essentially the same diameter. The propeller that is the front propeller in the direction of travel of the watercraft has blade configurations as determined by the known principles of marine engineering and naval architecture, and the propeller that is the rear propeller in the direction of travel of the watercraft has different blade configurations in the diameter range that is determined by the contraction of the jet leaving the front propeller and arriving at the second propeller. These parameters are readily discernible from the principles of marine engineering and naval architecture, and readily accomplished by those of skill in the art. The rear propeller in the direction of travel of the watercraft has the same blade configuration as the first propeller in an annular area located outside the diameter range determined by the jet contraction.

The invention relates to a watercraft drive for a watercraft having a hull, said watercraft drive having, drive means including a motor having at least one drive shaft, front and rear propellers respectively mounted on said drive shaft in coaxial longitudinally displaced relationship, each of said propellers having at least two blades, said front and rear propellers having equal diameters and being driven at like rotational velocities, control means disposed between said front and rear propellers, for increasing the energy of a jet of water exiting the front propeller as said jet is transmitted to the rear propeller, said control means causing the water jet leaving the front propeller with both circular and axial flow components to reach the rear propeller substantially without circular components, said control means comprising, a hollow shaft having an upper end connected to said hull, and a lower end, a gondola-shaped underwater housing mounted on the lower end of said hollow shaft and containing said drive means, said drive shafts extending from opposite ends of said housing, and a plurality of guide blades connected to at least one of said hollow shaft and gondola-shaped underwater housing, power means mounted in said hull for transmitting power through said hollow shaft to said drive means for rotating said front and rear propellers, said motor having a rotor covered by a motor housing, and said motor housing being connected, in heat conducting relationship to the inside wall of said underwater housing, whereby heat from said motor is transferred to water surrounding said shaft and said underwater housing, the improvement comprising, the central portion of said rear propeller up to a diameter equal to the diameter of the water jet arriving at the rear propeller, which due to the action of the front propeller has a contracted cross section, is designed to optimize the jet energy exiting the front propeller, said rear propeller further having an annular area extending from said central portion to the outer circumference of the rear propeller, being designed with the same design as characterizes the front propeller, said annular area of the rear propeller receiving a flow of surrounding ambient water.

A watercraft drive in accordance with the above, wherein the pitch of the blades in the core area of the rear propeller is 1.04 to 1.52 times the pitch of the blades in the core area of the front propeller.

A watercraft drive in accordance with the above, wherein the pitch of the blades in the annular area of the front propeller is between 95 percent and 105 percent of the pitch of the blades in the annular area of the rear propeller.

A watercraft drive in accordance with the above wherein the pitches of the blades of each of the front and rear propellers is in the range of 0.9 to 1.6.

A watercraft drive in accordance with the above wherein the blades of the front and rear propellers have different degrees of arcing.

A watercraft drive in accordance with the above wherein said guide blades which have an arc length ratio in the range of 0.0 to 0.2 and an angle of incidence in the range of −7 to +7.

A watercraft drive in accordance with the above, wherein the control device has two guide blades which are angularly symmetrically disposed about the common axis of rotation of the front and rear propellers.

A watercraft drive in accordance with the above wherein the drive means further comprises a transmission, said drive shafts extending from opposite ends thereof, and a connection shaft extending from said transmission through said hollow shaft into said hull for connection to an engine disposed therein.

A watercraft drive in accordance with the above further comprising a plurality of electrical conductors extending from said motor through said hollow shaft into said hull for connection to a source of electrical power therein.

A watercraft drive in accordance with the above wherein said motor comprises a hydraulic engine operatively connected to hydraulic fluid lines extending through said hollow shaft into said hull for connection to a source of hydraulic power.

A watercraft drive in accordance with the above further comprising an accelerating nozzle jacketing the front propeller, said accelerating nozzle having a cross section that tapers from an inlet end upstream of the front propeller to a plane of rotation of the front propeller.

A watercraft drive in accordance with the above wherein each of said front and rear propellers is jacketed by a decelerating nozzle having a cross section which increases from a respective nozzle inlet to a plane of rotation of the respective propeller.

A watercraft drive in accordance with the above wherein the upper end of the hollow shaft is rotatably mounted on the hull for enabling rotation of the underwater housing relative to the hull.

A watercraft drive in accordance with the above, wherein the hollow shaft is rotatable about a longitudinal axis relative to the hull by 360 degrees.

A watercraft drive in accordance with the above further comprising a front hub for fastening the front propeller to its respective drive shaft and a rear hub for fastening the rear propeller to its respective drive shaft, the front hub and rear hub being contoured for enhancing flow from the front propeller to the rear propeller.

A watercraft drive in accordance with the above wherein the motor is a permanently excited synchronous electric motor.

A watercraft drive in accordance with the above further comprising clutch means for connecting said driving shafts to said rotor, said driving shafts passing concentrically through the rotor and extending from both ends of the rotor for receiving the propellers which rotate in unison with said driving shaft.

A watercraft drive in accordance with the above further comprising bearing means operatively mounted between said housing and said rotor.

A watercraft drive in accordance with the above further comprising rotor support tube means for coupling said drive shaft and said rotor.

A watercraft drive in accordance with the above wherein the axis of the hollow shaft intersects and is orthogonal to the axis of the drive shaft, and further comprising a carrier cone to which the upper end of the hollow shaft is connected, the housing being continuously pivotable by 360 degrees around the longitudinal axis of the hollow shaft.

A watercraft drive in accordance with the above, wherein the hollow shaft and the carrier cone are mutually detachably connected in a plane of the hull.

A watercraft drive in accordance with the above wherein the carrier cone has a large end and a small end having a smaller cross section than said large end, the hollow shaft being connected to the small end of the carrier cone and the large end of the carrier cone being connected to the watercraft within the hull.

A watercraft drive in accordance with the above wherein the hollow shaft comprises one of said guide blades that are rotationally symmetrical disposed about the common axis of rotation of the front and rear propellers.

A watercraft drive in accordance with the above wherein the front propeller is jacketed by a decelerating nozzle having an inlet and a cross section which increases from the inlet to the plane of rotation of the propeller.

A watercraft drive in accordance with the above wherein each of the front and rear propeller is jacketed by one of an accelerating nozzle having an inlet and a cross section that decreases with distance from its inlet to the plane of rotation of its respective propeller, and a decelerating nozzle having an inlet and a cross section that increases from its inlet to the plane of rotation of its respective propeller.

A watercraft drive in accordance with the above wherein each of the front and rear propellers is surrounded either one of an accelerating nozzle having an inlet and a cross section decreasing with distance from the inlet of the nozzle toward the plane of rotation of the first propeller, and a decelerating nozzle having a cross section increasing with distance from the inlet of the nozzle toward the plane of rotation of the first propeller.

A watercraft drive in accordance with the above wherein said motor is an electric motor having a rotor and a stator and further comprising, a first support tube connected in heat conducting relationship to said rotor, a second support tube having an inner surface connected in heat conducting relationship to said stator and an outer surface connected in heat conducting relationship to said underwater housing, means for connecting said shafts to said first support tube, a plurality of flanges connected in heat conducting relationship to said underwater housing, and bearing means operatively connected between said first support tube and said flanges, whereby heat from said rotor and stator is conducted to ambient water surrounding said underwater housing and shaft for cooling said motor.

These and other features of the present invention appear from the following description of a plurality of exemplary embodiments of the present invention, the exemplary embodiments of the present invention shown in the drawings, and, finally, from the claims.

Figure 7:
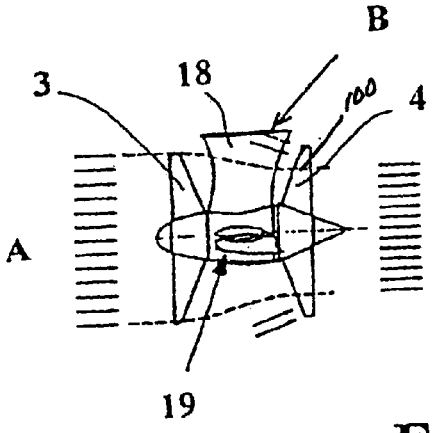
Figure 3A:
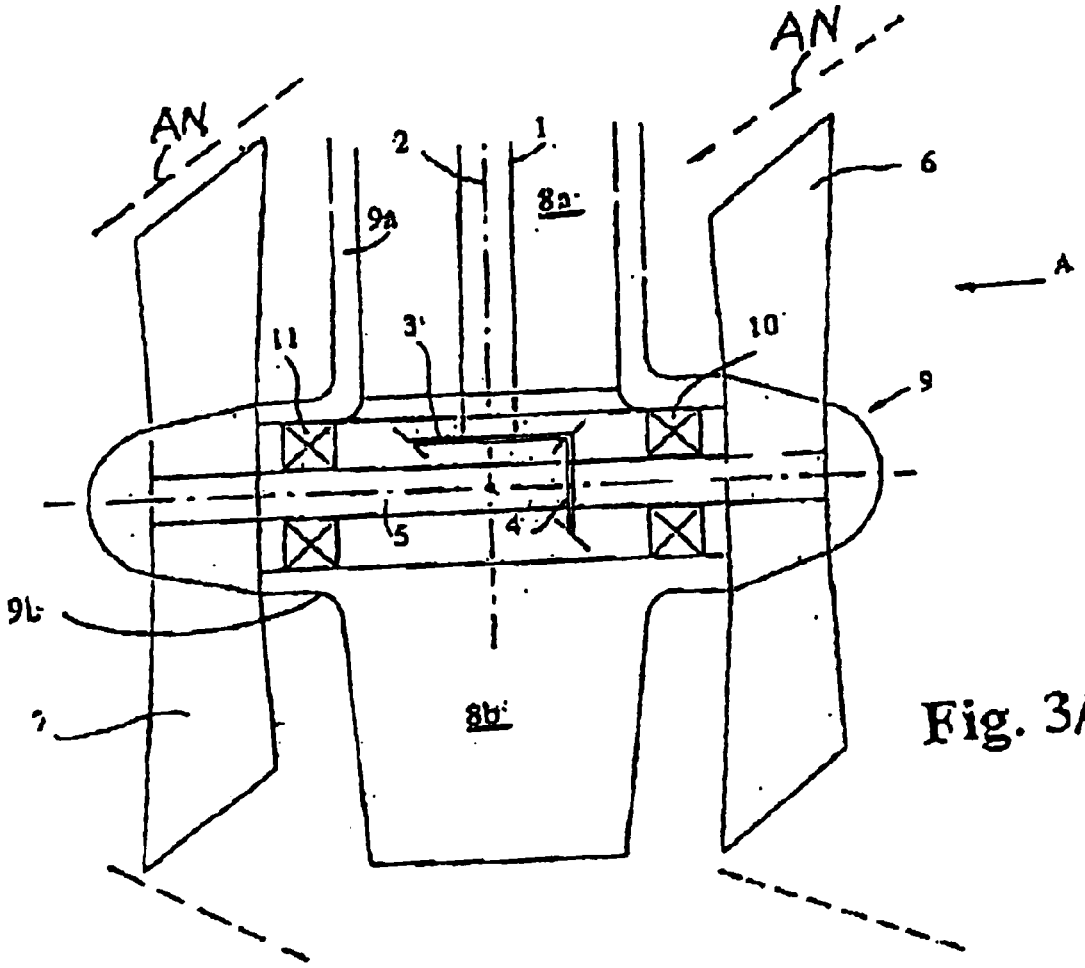
FIG. 3A shows an accelerating nozzle surrounding each of the front and rear propellers.
Figure 3B:
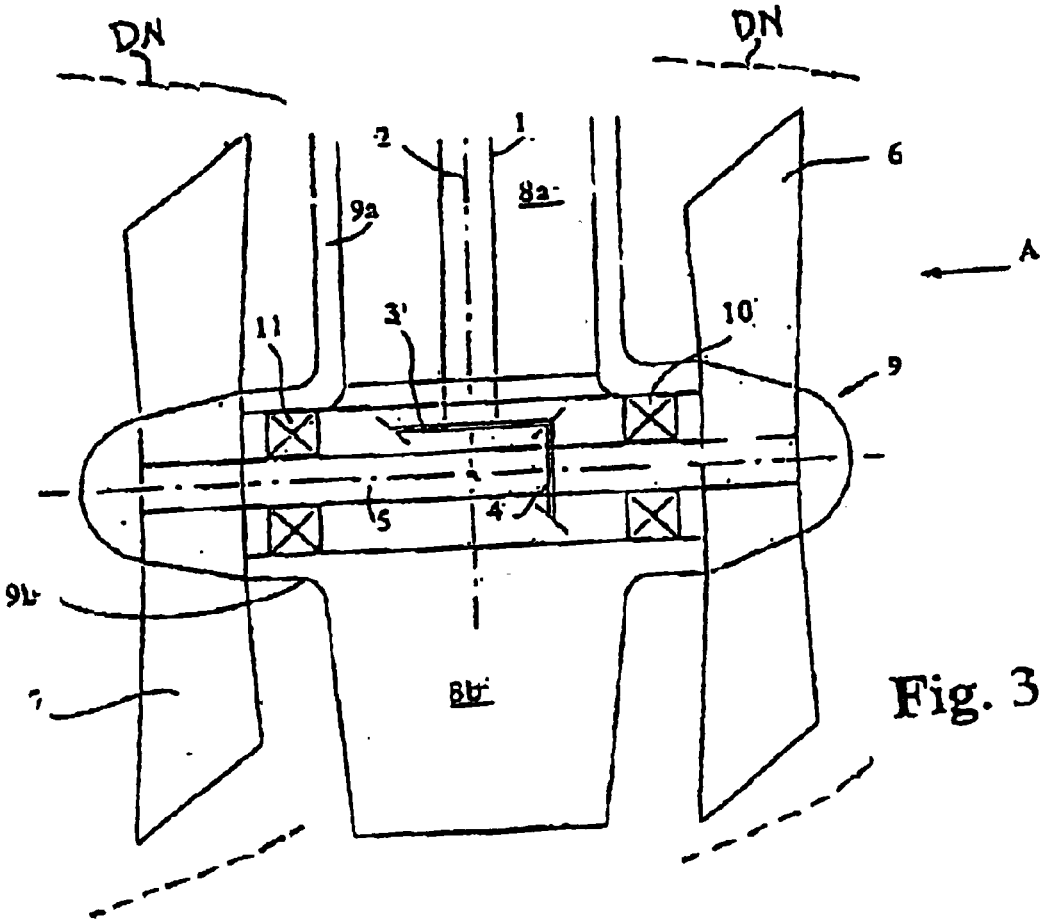
FIG. 3B shows a decelerating nozzle surrounding each of the front and rear propellers.
Figure 3C:
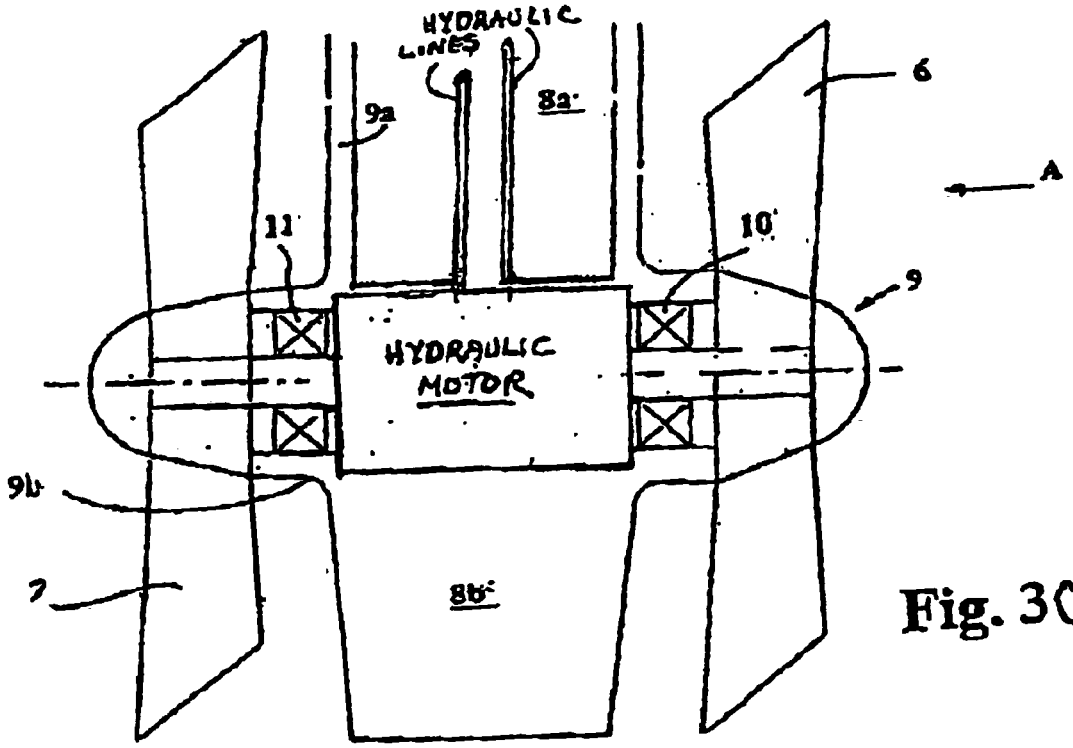
FIG. 3C shows an embodiment that employs a hydraulic motor with hydraulic lines leading up to the watercraft and a source of hydraulic power (not illustrated).
Figure 4:
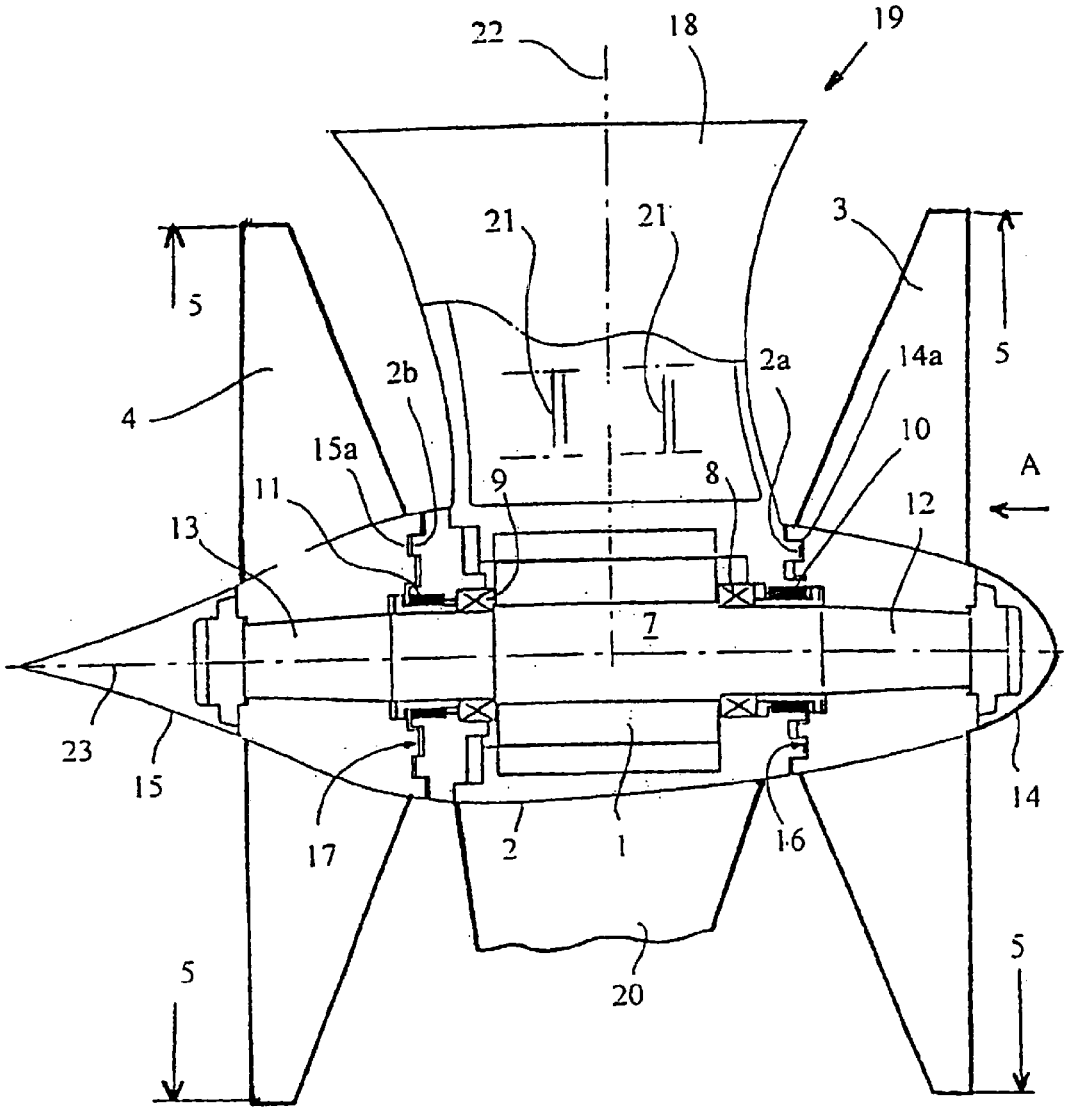
Figure 5:
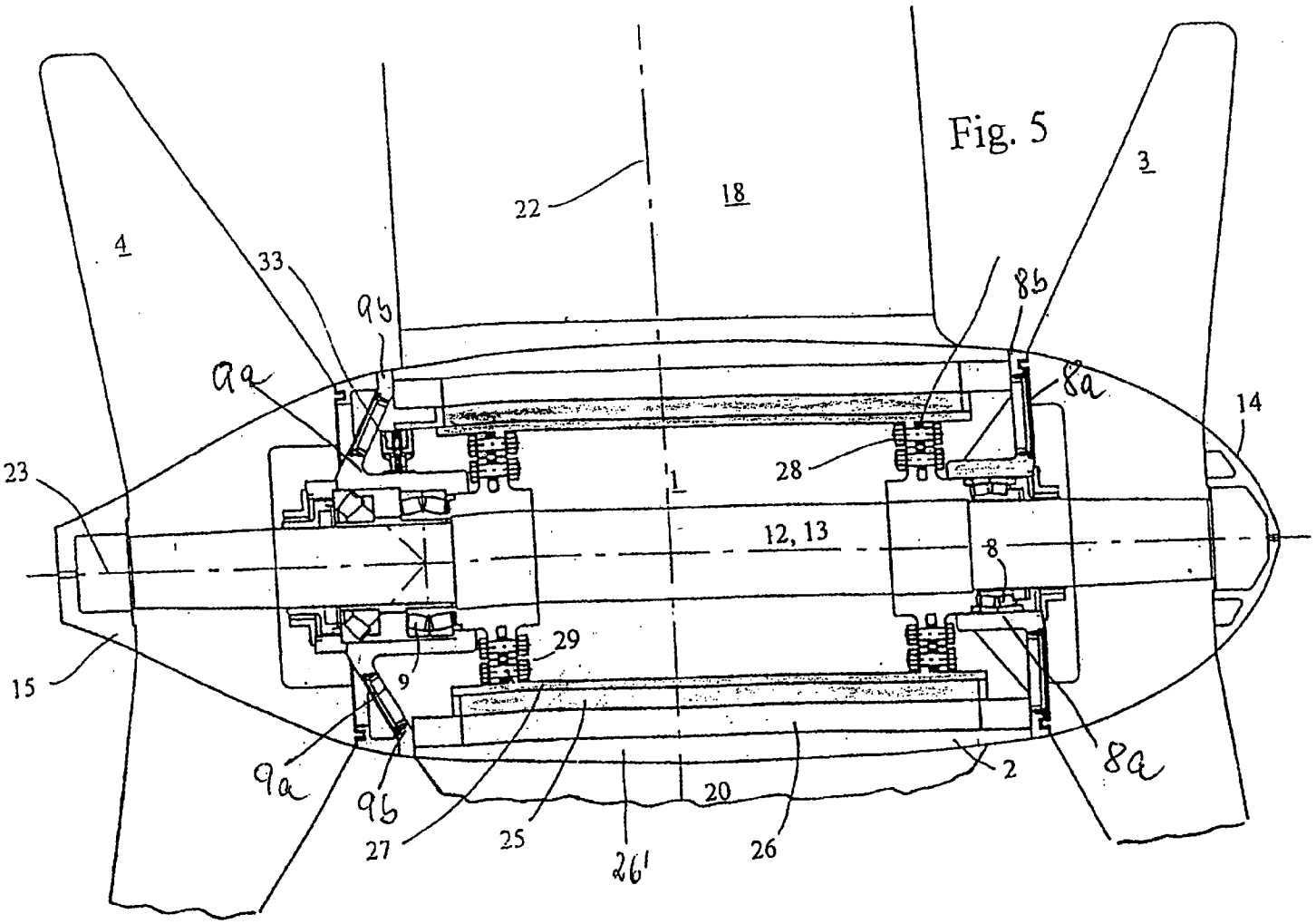
Figure 6:
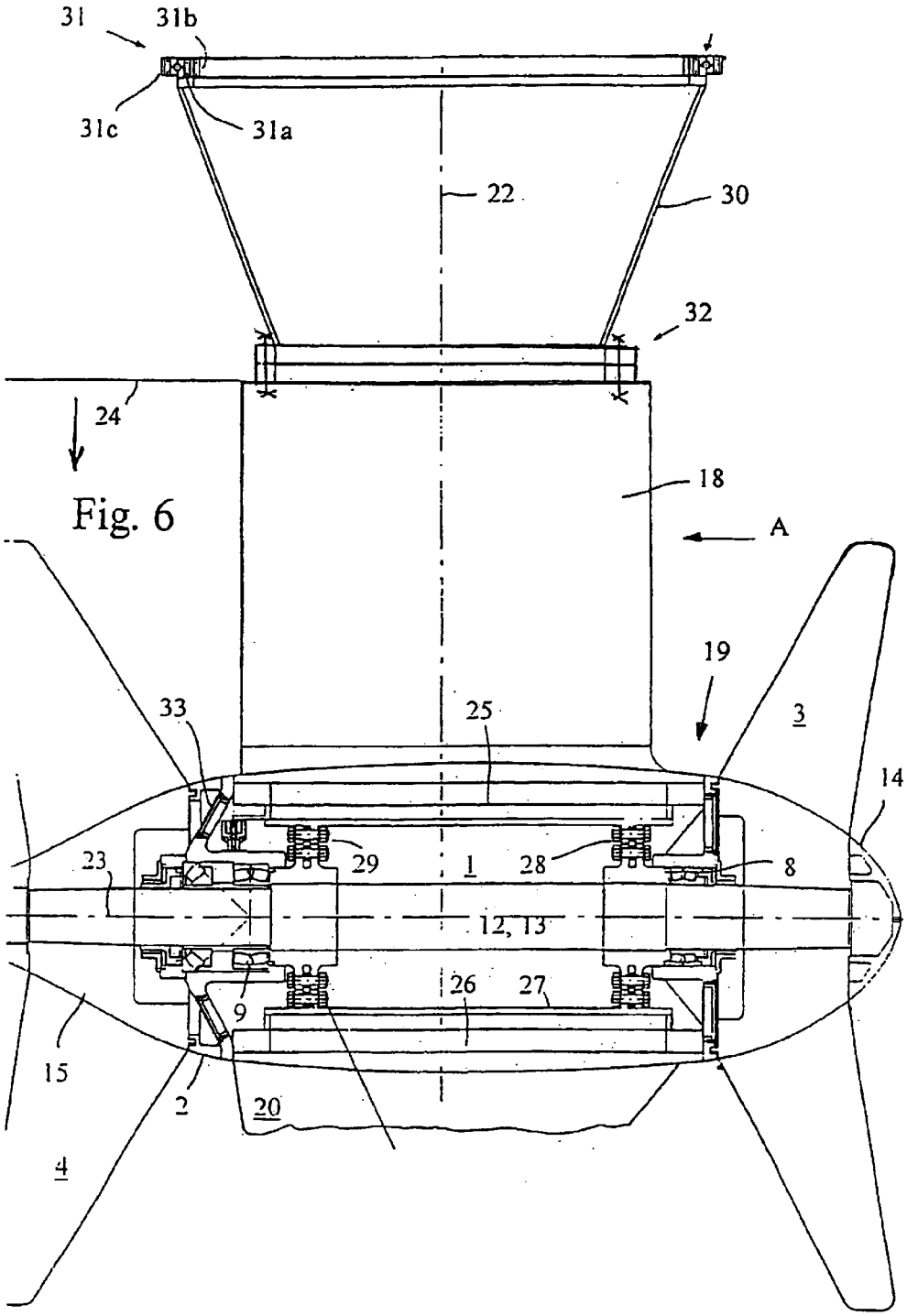

housing shaft from a drive motor, which is arranged inboard and is not shown but may be a usual internal combustion engine, an electric motor or the like, is arranged in the underwater housing;

FIG. 4 through FIG. 6 show, in representations which correspond to be above representations, three variants of an additional exemplary embodiment with an electric motor in the underwater housing, to which energy is supplied from an inboard power generator via cables, which are led through the housing shaft; and FIG. 7 shows a twin-propeller design, which is particularly advantageous and is a twin-propeller arrangement that is especially the subject of the present invention and may be used in all the above-mentioned embodiments.

DETAILED DESCRIPTION OF PREFERRED EMBODIMENTS OF THE INVENTION

Figure 1:
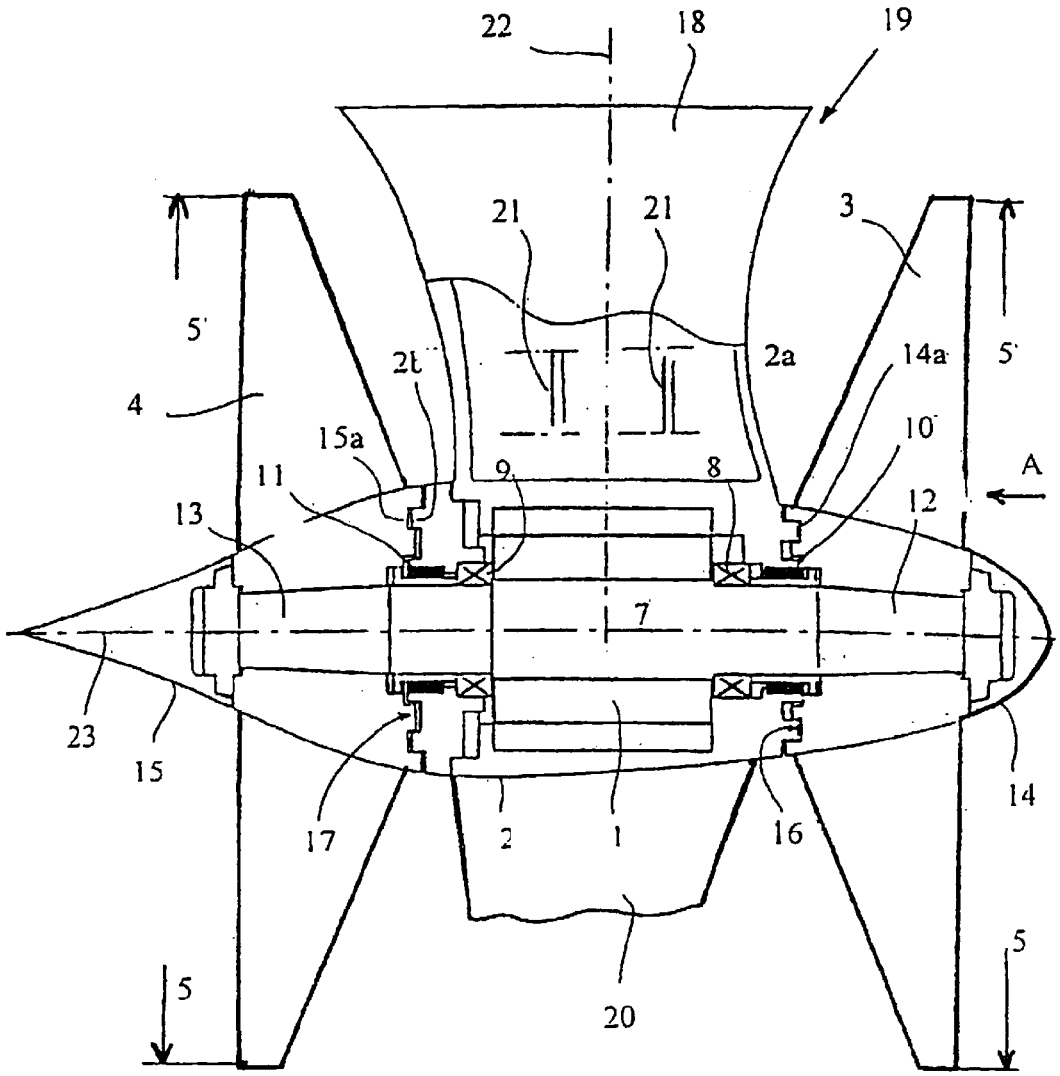
FIG. 1 shows a first exemplary embodiment of a hydrojet according to the present invention with one propeller each at the ends of a shaft led out of a gondola like underwater housing, which has a favorable design with respect to flow, is arranged by means of a housing shaft or foot on the underside of a ship under the ship and accommodates an electric motor, on the shaft or ends of which a propeller each is arranged.

Description of the Embodiment According to FIG. 1. The drive comprises essentially an electric motor 1 in a housing 2 outside and especially under the hull and two propellers, 3, 4, which are driven by the electric motor 1. The two propellers are of different designs, even though they may have tip circles 5 of equal diameter as well as a similar wing geometry. They have the same direction of rotation and the same speed of rotation and the flow is directed toward them in the same direction, e.g., according to arrow A By reference to FIG. 7, it will be apparent that the stream leaving the first propeller 3, designed in conventional terms, is contracted due to known phenomenon to a diameter as shown in dotted lines, thereby arriving at the second propeller 4 in a wake or stream having a smaller diameter than the propeller 4. In the invention, the central portion of the propeller 4 is given its conventional design for a two-propeller system. However, the annular portion of propeller 4 is given the conventional design of propeller 3, and thus, is a hybrid, the central core or portion corresponding to the diameter of the contracted stream being designed conventionally as a second propeller in a two-propeller system and the annular part being conventionally designed like propeller 3. The propeller 3 that is the front propeller in the direction A of the incoming flow has an optimal blading for increasing the energy of the flow medium. The propeller 4 that is the rear propeller in the direction A of the incoming flow has the same blading in this respect but only in the peripheral area. This peripheral area surrounds a central area, in which the blading differs from that of the front propeller 3 as described above, i.e., it once again increases the energy increased in the first propeller from this energy level after the flow medium leaving the first propeller 3 has been untwisted in a conventional control device 19 and the energy loss caused by the twist has been compensated. The core area and the peripheral area are separated from one another by the contraction surface or interface 100. It is possible that a jacket surface be fixed in position, which surrounds the flowing fluid after it has left the first propeller 3 and circumscribes a cross section that is markedly smaller than the whole incoming flow cross section to propeller 4. The flow medium B consequently flows to the second propeller 4 in the peripheral area in the same manner as the flow medium that is characterized by the arrows A flows to the first propeller 3.

Referring back to FIG. 1, the electric motor 1 is arranged in the underwater housing 2 in a watertight manner. The driven shaft 7 is led out of it on both sides and the shaft is mounted in it rotatably in one of two bearings 8, 9 of the housing 2 to the side of the motor. Seals 10,11 to the side of the bearings 8, 9 between the shaft and the front-side housing walls 2*a*, 2*b* are used for sealing in conjunction with the front surfaces being designed as parts of labyrinth seals. Shaft ends 12, 13, each of which carries one of the two propellers 3, 4, rotating in unison, are flanged on the shaft 7 outside the housing 2. On the front side, the housing 2 is joined by hub caps 14, 15, wherein a continuous outer contour with head 14, which said contour is favorable in terms of flow, is formed in the area of the front propeller 3, the middle part in the form of the housing 2 and the end part 15 in the area of the rear propeller 4. The front walls 14*a*, 15*a* of the hub caps 14, 15 facing the housing 2 are second parts of the labyrinth seals 16, 17, whose first parts are the aforementioned front surfaces 2*a*, 2*b*. The housing 2 is held at the hull with a foot 18, which is designed as a hollow foot, whose outer contour is part of the control device 19 between the propellers 3, 4, which has additional blades associated with the housing 2, of which one blade, which is located diametrically opposite the foot 18, is designated by 20. On the whole, the blades of the control device 19 are rigidly associated with the housing distributed uniformly around the longitudinal axis of the shaft 7.

On the whole, the propellers 3, 4 are designed such that the output energy level of the second propeller 4 is approximately equal to the final energy level of the first propeller 3 and, in conjunction with the control device 19, the output twist of the first propeller 3 as well as the input twist of the second propeller 4 are influenced corresponding to the purpose such that only slight energy losses occur at best at the time of the transition of the liquid from the first propeller to the second one.

The energy is supplied to the electric motor by lines 21, which are led to the motor in the foot 18 and in the housing 2, and the inner spaces of the foot 18 and of the housing 2 are therefore in connection with one another.

To make it possible to use the drive not only to generate a thrust in the longitudinal direction of the ship (longitudinal axis of the drive shaft), but also to steer the ship, the entire drive is pivotable around the vertical longitudinal axis 22 in the middle between the two propellers, optionally all around by 360 degrees due to the corresponding association with the ship and by means of an appropriate pivoting mechanism in the known manner, the axis 22 being directed at right angles to the axis of rotation of the longitudinal axis 23' of the shaft.

Figure 2:
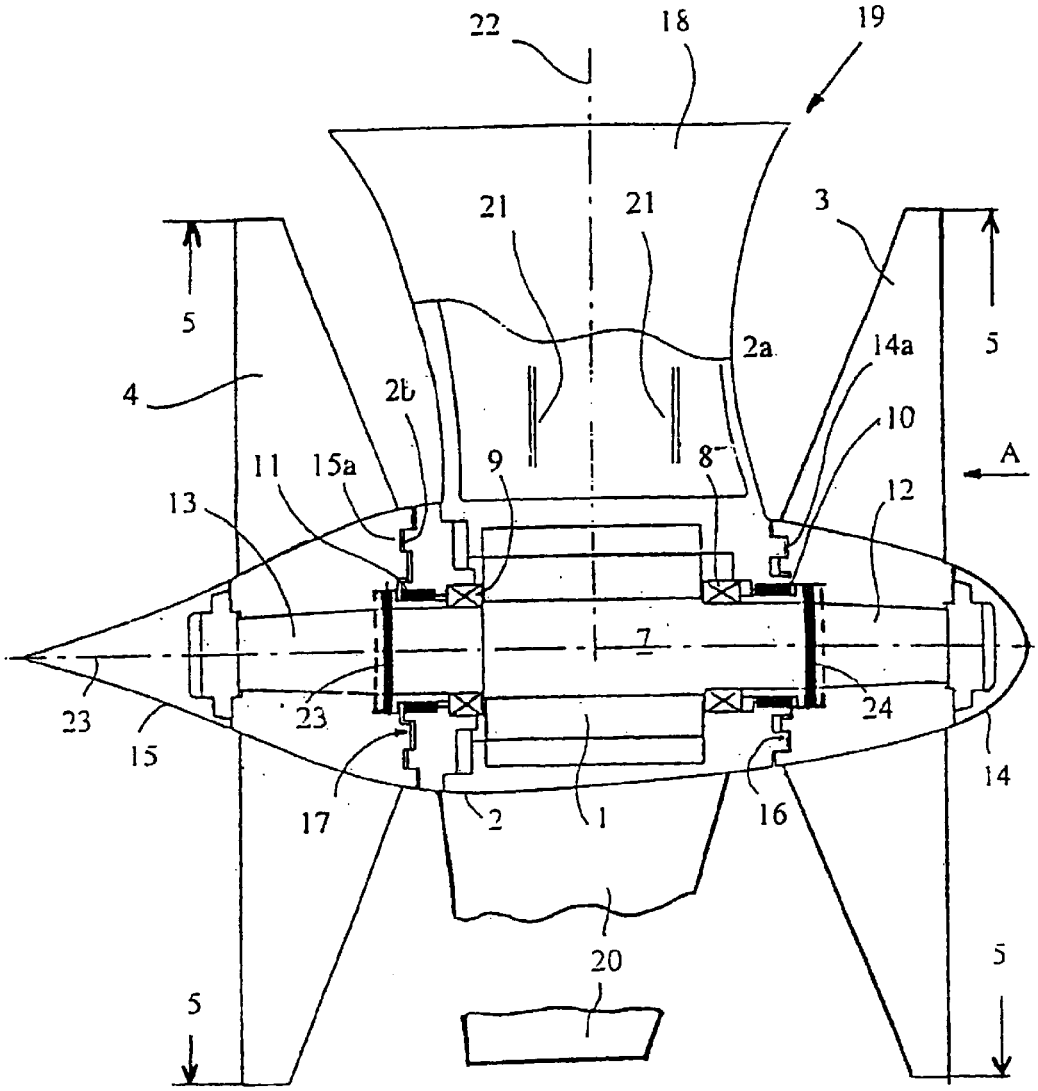
FIG. 2 shows a second exemplary embodiment of another design that is advantageous compared with FIG. 1.

Description of the Embodiment According to FIG. 2. The drive comprises essentially an electric motor 1 in a housing 2 outside and especially under the hull and two propellers 3, 4, which are driven by the electric motor 1. The two propellers have different designs as discussed above, even though they may have tip circles 5 of equal diameter as well as similar wing geometry. They have the same direction of rotation and the same speed of rotation and the flow is directed toward them in the same direction, e.g., according to the arrow A.

The electric motor 1 is arranged in the underwater housing 2 in a watertight manner. The driven shaft 7 is led out of it on both sides and is mounted in it rotatably in one of two bearings 8, 9 each of the housing 2 to the side of the motor. Seals 10, 11 to the side of the bearings 8, 9 between the shaft 7 and the front-side housing walls 2*a*, 2*b* are used for sealing in conjunction with the front surfaces being designed as parts of labyrinth seals. Shaft ends 12, 13, each of which carries one of the two propellers 3, 4, rotating in unison, are flanged to the shaft 7 outside the housing 2. On the front side, the housing 2 is joined by hub caps 14, 15, wherein a continuous outer contour with head 14, which contour is favorable with respect to flow, is formed in the area of the front propeller 3, the middle part in the form of the housing 2 and the end part 15 in the area of the rear propeller 4. The front walls 14*a*, 15*a* of the hub caps 14, 15 facing the housing 2 are two parts of the labyrinth seals 16, 17, whose first parts are the aforementioned front surfaces 2*a*, 2*b*. The housing 2 is held at the hull with a foot 18, which is designed as a hollow foot, whose outer contour is part of the control device 19 between the propellers 3, 4 which has additional blades associated with the housing 2, of which one blade, which is located diametrically opposite the foot 18, is designated by 20. On the whole, the blades of the control device 19 are rigidly associated with the housing 2, uniformly distributed around the longitudinal axis of the shaft 7.

On the whole, the propellers 3, 4 are designed such that the output energy level of the second propeller 4 is approximately equal to the final energy level of the first propeller 3 and, in conjunction with the control device 19, the output twist of the first propeller 3 as well as the input twist of the second propeller 4 are influenced corresponding to the purpose such that only slight energy losses occur at best at the time of the transition of the liquid from the first propeller to the second one.

The energy is supplied to the electric motor by lines 21, which are led to the motor in the foot 18, and in the housing 2, and the inner spaces of the foot 18 and of the housing 2 are therefore in connection with one another.

To make it possible to use the drive not only to generate a thrust in the longitudinal direction of the ship (longitudinal axis of the drive shaft), but also to steer the ship, the entire drive is pivotable around the vertical longitudinal axis 22 in the middle between the two propellers, optionally all around by 360 degrees due to the corresponding association with the ship and by means of an appropriate pivoting mechanism in the known manner, the axis 22 being directed at right angles to the axis of rotation of the longitudinal axis 23 of the shaft.

The motor 1 is designed as a permanent synchronous motor and thus it is an electric machine with very high power density. Due to the technology of such a motor, it is possible to design the housing 2 between the two propellers hydrodynamically such that a very high efficiency will be reached.

It is possible in the case of this technology for the foot 18 to be designed as a shaft, so that it will also have an optimal hydrodynamic shape. In the lower area located in the proximity of the housing 2, the shaft 18 is designed such that it forms a guide fin pair and thus a control device together with a second, diametrically opposite guide fin 20, so that an optimal flow of water to the propeller 4, which is the second propeller when viewed in the oncoming flow direction A, is possible. The guide fins end in the tip circles 5 of equal diameter of the two propellers 3, 4.

Due to the combination of the permanent synchronous motor of high power density on a small diameter with the optimal guide means (guide fin pair or control device 20) as well as with the two propellers 3, 4, designed as described above, a drive unit is obtained which is characterized by an extremely great improvement in efficiency both electrically and hydrodynamically.

The design of the motor 1 as a permanent synchronous motor makes it possible to reduce the diameter of the housing 2 by up to 20% compared with other, prior-art motors. The advantages are obvious: Only the smaller masses and more favorable flow conditions and lower flow resistance shall be mentioned.

Another design according to the present invention pertains to the mounting of the rotor of the permanent motor, which also contains the mounting of the propeller shaft. To reduce or eliminate the displacements and deformations as well as the dynamic loads from the propellers, the rotor, i.e., the drive shaft 7, is connected to the propeller shafts 12, 13 via disk clutches 23, 24. As a result, it is possible to obtain a minimal air gap between the stator and the rotor, which means a considerable, additional improvement in efficiency.

Figure 3:
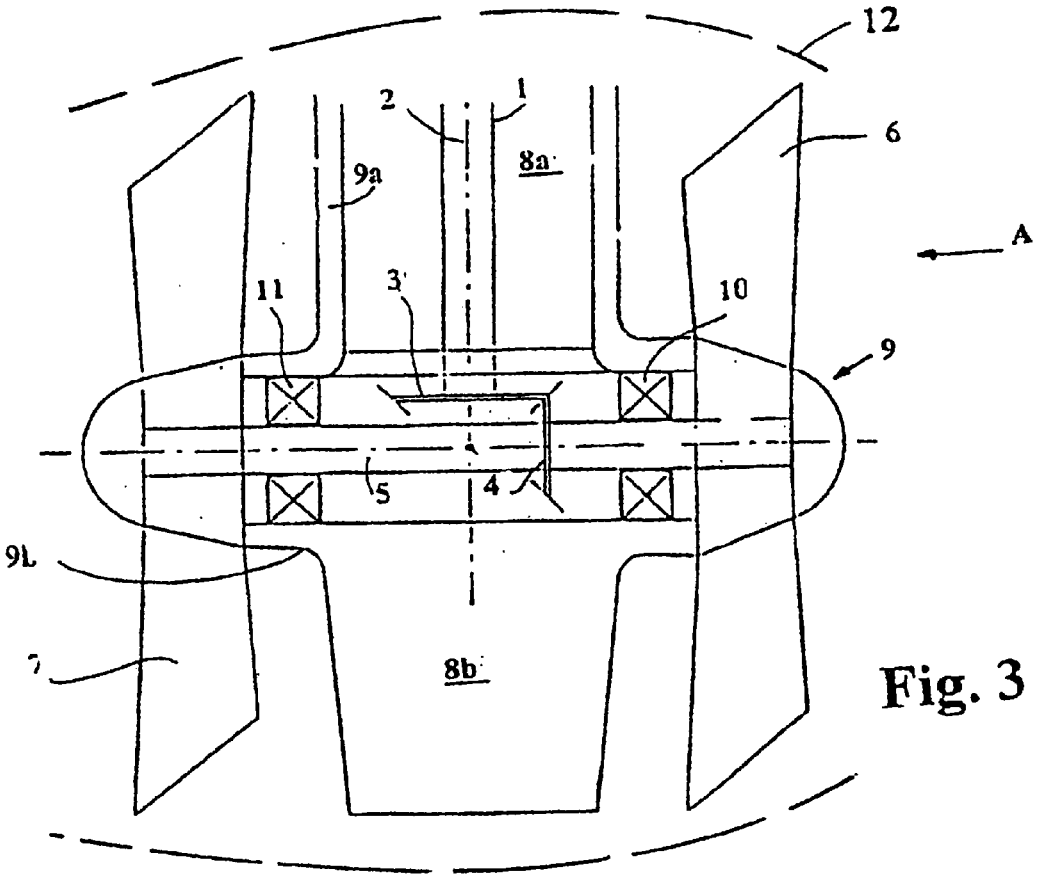
FIG. 3 shows a third exemplary embodiment, in which a right-angle gear drive, into which drive energy is supplied via a shafting accommodated in a jacket tube

Description of the Exemplary Embodiment According to FIG. 3

FIG. 3 shows a ship drive designed as a rudder twin propeller with a drive unit arranged in the hull with vertical drive shaft 1 and drive propellers outside the hull. A drive unit comprising a motor and transmission acts on the top end of the vertical drive shaft 1 in the known manner, therefore not shown in FIG. 3, in order to set the drive shaft 1 into rotation around the longitudinal axis 2 at variable speed of rotation. The input bevel gear 3 of a right-angle gear drive 3, 4, which bevel gear 3 is in functional connection with the output bevel gear 4 of the right-angle gear drive 3, 4, is associated with the lower end of the drive shaft 1, rotating in unison. The output bevel gear 4 carries a horizontal output shaft 5 extending in both directions, rotating in unison with it, with the propellers 6, 7 arranged at the free ends of the output shaft, rotating in unison with it. The propellers usually have different designs, even though tip circles 14 of equal diameter as well as similar wing geometries may be possible. Due to the joint association with the output shaft 5, they have the same direction of rotation and the same speed of rotation and the flow is directed toward them in the same direction, e.g., according to arrow A.

The right-angle gear drive 3, 4 is surrounded by a housing 9, in which the output shaft 5 is mounted rotatably by means of two bearings 10,11. This housing 9 is carried by a housing pipe 9*a*, which concentrically surrounds the vertical drive axis 1 and is pivotable around its longitudinal axis for the rudder function.

The underwater part of the drive system may be arranged within a nozzle 12.

In its wake, the front propeller 6 generates a rest or after twist, which represents lost energy. The wake of the front propeller is admitted to the downstream propeller 7, rotating in the same direction. Without a guide means between the two propellers 6, 7 the above-mentioned unfavorable wake would lead to intensified cavitation and to an increase in the energy losses.

To counteract this energy loss, a guide means 8, with which the after twist of the front propeller 6 is directed, is provided between the two propellers 6, 7. Lost energy is now recovered by a propulsive force being generated during the flow around the guide means. Furthermore, a pretwist is generated for the downstream propeller 7, so that the latter can realize a greater energy gradient. Taking this criterion into account, the second propeller 7 in its central region or diameter has a design different from that of the first propeller 6, as described above. According to FIG. 3, the guide means 8 comprises two guide blades 8*a* and 8*b*, wherein one guide blade 8*a* is formed by the housing pipe 9*a* surrounding the vertical drive shaft 1. The second guide blade 8*b* is located on the underside 9*b* of the housing 9 surrounding the horizontal output shaft 5, i.e., offset by 180° from the first guide blade. The two guide blades 6, 7 form an assembly unit with the overall housing 9, 9*a*.

Description of the Exemplary Embodiment According to FIG. 4 Through FIG. 6.

The drive comprises essentially an electric motor 1 in a housing 2 outside and especially under the hull and two propellers 3, 4, which are driven by the electric motor 1. The two propellers are of different design as explained above, even though they may have tip circles 5 of equal diameter as well as a similar wing geometry. They have the same direction of rotation and the same speed of rotation and the flow is directed toward them in the same direction, e.g., according to arrow A.

The electric motor 1 is arranged in the underwater housing 2 in a watertight manner. The driven shaft 7 is led out of it on both sides and the shaft is mounted in it rotatably in one of two bearings 8, 9 of the housing 2 to the side of the motor. Seals 10, 11 to the side of the bearings 8, 9 between the shaft 7 and the front-side housing walls 2*a*, 2*b* are used for sealing in conjunction with the front surfaces being designed as parts of labyrinth seals. Shaft ends 12, 13, each of which carries one of the two propellers 3, 4, rotating in unison, are flanged on the shaft 7 outside the housing 2. On the front side, the housing 2 is joined by hub caps 14, 15, wherein a continuous outer contour with head 14, which said contour is favorable in terms of flow, is formed in the area of the front propeller 3, the middle part in the form of the housing 2 and the end part 15 in the area of the rear propeller 4. The front walls 14*a*, 15*a* of the hub caps 14, 15 facing the housing 2 are second parts of the labyrinth seals 16, 17, whose first parts are the aforementioned front surfaces 2*a*, 2*b*. The housing 2 is held at the hull with a foot 18, which is designed as a hollow foot, whose outer contour is part of the control device 19 between the propellers 3, 4, which has additional blades associated with the housing 2, of which one blade, which is located diametrically opposite the foot 18, is designated by 20. On the whole, the blades of the control device 19 are rigidly associated with the housing 2, distributed uniformly around the longitudinal axis of the shaft 7.

On the whole, the propellers 3, 4 are designed such that the output energy level of the second propeller 4 is approximately equal to the final energy level of the first propeller 3 and, in the control device 19, the output twist of the first propeller 3 is removed from the input to the second propeller 4, and thus only slight energy losses occur, at worst, at the time of the contraction and transition of the liquid from the first propeller to the second one.

When leaving the first propeller 3 the water flow has an axial component ("conveyor direction") and a circumferential component ("twist"). The latter component, i.e. the component in the circumferential direction, is deflected by a guide blade 19 into the axial direction, so that the water flow entering the second propeller 4 has only components in the axial direction, similar to the water flow entering the first propeller 3, except that the flow stream has been contracted due to the increased flow rate reduced pressure, and other parameters well known to those skilled in the art.

The energy is supplied to the electric motor by lines 21, which are led to the motor in the foot 18 and in the housing 2, and the inner spaces of the foot 18 and of the housing 2 are therefore in connection with one another.

To make it possible to use the drive not only to generate a thrust in the longitudinal direction of the ship (longitudinal axis of the drive shaft), but also to steer the ship, the entire drive is pivotable around the vertical longitudinal axis 22 in the middle between the two propellers, optionally all around by 360 degrees due to the corresponding association with the ship and by means of an appropriate pivoting mechanism in the known manner, the axis 22 being directed at right angles to the axis of rotation of the longitudinal axis 23 of the shaft.

An especially advantageous embodiment of the drive according to the present invention will be described below with reference to FIGS. 5 and 6. The electric motor 1 is advantageously, but not essentially, a permanently excited synchronous motor with permanent magnet rotor 25 and stator laminations 26. Such motors have are known in the art, so that the electric motor, which is advantageously a permanently excited synchronous motor, as well as other suitable types of electric motors, are not specifically described.

The use of such a motor in the housing 2, which has a gondola-like design and is arranged under the hull of the ship 24, beneath the water surface, for driving the two co-rotating propellers 3, 4, which face the same direction A, has various application-specific advantages, especially in terms of electric efficiency, and it makes it possible to dispense with forced cooling apparatus. In addition, a small overall volume is made possible which in turn makes possible an optimal shape of the underwater housing with respect to resistance, especially a housing with a small maximum diameter. The gondola-shape of the housing 2 performs a guiding function whereby the gondola-shaped housing 2 serves as part of the control device in addition to the guide fins 20 and hollow shaft or foot 18.

In order to be able to avoid forced cooling, the outer stator 26 is constructed as a laminated yoke of the electric motor 1, and is connected tightly and in direct heat contact to the underwater housing 2. The inner rotor 25 of the motor 1 is rigidly connected via support tube 27 to the rotatable shafts 12, 13. In a similar way, the stator 26 is rigidly supported in the housing 2 via support tube 26' which is made of heat conducting material, and which is firmly connected to the motor 26, as well as to the housing 2. In this arrangement there is direct heat transfer from the stator 26 of the motor (motor housing) to the support tube 26' and finally to the underwater housing 2, from which the heat is dissipated into the surrounding water flow. The underwater housing 2, the support tube 26' and the motor housing 26 are, thereby, sufficiently cooled.

The tight connection between support tube 26' and underwater housing 2, and between stator 26 and support tube 26', respectively, can be accomplished, e.g., by pressing each inner part held at lower temperature into the respective outer part held at a higher temperature. In use, at running temperature, the two parts will then be tightly connected.

For cooling the bearings 8, 9 correspondingly, the bearings 8, 9, which support the shafts 12, 13, are in turn supported by flanges 8*a*, 9*a* that are made of heat conducting material. The outer flange surfaces 8*b*, 9*b* are tightly connected to the inner surface of the underwater housing 2 and to the motor housing 26.

In another design, such a permanently excited synchronous motor is arranged in the gondola-like housing 2 such that the continuous propeller shaft 12, 13 and the rotor 25 have a common mounting with the two bearings 8, 9. This is specifically realized such that the permanent rotor 25 is seated on a support tube 27, which is concentrically surrounded by it and which is associated with the propeller shaft 12, 13, rotating in unison with it, in the proximity of its two ends via one of two annular disk clutches 28, 29 each, wherein the disk clutches 28 and 29 as well as the corresponding bearing 8 or 9 are located close to one another at the two shaft ends. Due to the propeller shaft and the electric motor tube having a common mounting, the number of components is minimized and the reliability of the drive unit is increased. Due to the use of the respective disk clutch located in close proximity to the respective plain bearing, a highly accurate centering of the rotor, which is extensively independent from the sag of the propeller shaft, is achieved within the stator. This leads to considerable advantages in terms of the dynamic behavior of the rotor within the machine (e.g., the excitation of structure-borne noise is minimized).

Likewise as a consequence of the electric motor being designed as a permanently excited synchronous motor 1 (FIGS. 2, 3), integration of the underwater housing shaft 18 (called a "foot" in connection with FIG. 1) within the drive is possible in a particularly advantageous manner.

This housing shaft may be made as an especially slender shaft, as a result of which the flow resistance of the unit is considerably reduced. This slender underwater housing shaft 18 has such a cross-sectional profile that an additional untwisting of the wake of the front propeller 3 is achieved in conjunction with a lateral guide fin pair (not shown), which is offset by 90 degrees, the geometry of the housing 2, and the opposite guide fin 20, which is offset by 180 degrees. This results in an improvement in efficiency of the drive with two co-rotating propellers (in terms of speed of rotation and direction of rotation, otherwise designed to the criteria specified above).

A parking brake for fixing the propeller shaft 12, 13 and thus the assembly unit, whose parts include the propeller shaft, is arranged within the underwater gondola 2 and is designated by 33.

Finally, the design according to FIGS. 5, 6 leads to an essential simplification of the underwater assembly efforts.

Rudder propellers that can be assembled/disassembled with the ship floating are offered by various rudder propeller manufacturers. The corresponding assembly effort is still considerable. The present invention makes possible, especially in the embodiment according to FIGS. 5 and 6, a greatly simplified underwater assembly/disassembly at the underwater housing shaft/carrier cone separation point. The underwater housing shaft is also designated by the reference number 18 in FIG. 6; its top end is located in the plane 24 of the shell of the ship and is connected to the carrier cone 30. At the top end, the carrier cone is mounted in a steering bearing 31 in the support structure of a ship. This steering bearing 31 has an inner ring 31*a* with an inner toothed ring 31*b*, and this bearing inner ring 31*a* is rigidly associated with the outer circumference of the carrier cone 30. The outer ring 31*c* cooperates with the inner ring via the rolling bodies and it is rigidly integrated in the support structure of the ship. The pinion (not shown) of a drive (not shown) engages the inner toothed ring of the inner ring of the steering bearing, so that the entire drive can be rotated by 360 degrees around the longitudinal axis 22 for steering the ship.

The detachable connection between the housing shaft 18 and the carrier cone 30 is symbolized by a flanged connection 32.

Common to all embodiments is the combination of the features claimed, according to which the drive is a hydrojet for watercraft, especially ships, which has a drive unit and two propellers driven by same, which said propellers are arranged at the two ends of a gondola-like, streamlined underwater housing outside the underwater housing and are driven by a drive means, which is located within the underwater housing and a common drive shaft acts on the two propellers, wherein the first propeller markedly increases the flow energy of the flow medium and this flow medium is supplied with a high energy content, after eliminating the inevitable aftertwist in a guide means, to the second propeller, which differs from the first propeller in terms of its blading such that the relatively low flow energy in the first propeller is optimally increased, while the relatively high flow energy is increased further in the second propeller; in a special embodiment, described below on the basis of FIG. 2, the second propeller is a hybrid design that has a central part, which differs from the first propeller in the described manner, and a peripheral part, which is identical to the first propeller to this extent and to which the medium flows in the same manner as to the first propeller.

Description of the Embodiment According to FIG. 7.

As previously mentioned, the propeller 3 that is the front propeller in the direction A of the incoming flow has an optimal blading for increasing the energy of the flow medium. The propeller 4 that is the rear propeller in the direction A of the incoming flow has the same blading in this respect in a peripheral area. This peripheral area surrounds a central area, in which the blading differs from that of the front propeller 3 as was described several times above, i.e., it once again increases the energy increased in the first propeller from this energy level after the flow medium leaving the first propeller 3 has been untwisted in the control device 19 and the energy loss caused by the twist has been compensated. The core area and the peripheral area are separated from one another by the contraction surface 100, of the flowing contracted stream i.e., by the jacket surface, which surrounds the flowing fluid after it has left the first propeller 3 and circumscribes a cross section that is markedly smaller, substantially contracted, than the incoming flow cross section. The flow medium B consequently flows to the second propeller in the peripheral area in the same manner as the flow medium that is characterized by the arrows A flows to the first propeller.

What is claimed is:

1. The combination comprising:

(a) a watercraft having a hull;

(b) a watercraft drive including at least one drive shaft;

(c) front and rear propellers, respectively mounted on said at least one drive shaft in coaxial longitudinally displaced relationship;

(d) each of said propellers having at least two blades;

(e) said front and rear propellers having equal diameters and being driven at like rotational velocities;

(f) control means disposed between said front and rear propellers, for increasing the energy of a jet of water exiting the front propeller as said jet is transmitted to the rear propeller;

(g) said control means acting on the water jet leaving the front propeller with both circular and axial flow components to reach the rear propeller substantially with axial flow components only;

(h) said control means comprising, (i) a hollow shaft having an upper end connected to said hull and a lower end, (ii) a gondola-shaped underwater housing mounted on the lower end of said hollow shaft and containing said watercraft drive with said at least one drive shaft extending from opposite ends of said underwater housing, and (iii) a plurality of guide blades connected to at least one of said hollow shaft and gondola-shaped underwater housing;

(i) an energy source mounted in said hull for transmitting energy through said hollow shaft to said watercraft drive for rotating said front and rear propellers;

(j) the central portion of said rear propeller up to a diameter equal to the diameter of a water jet arriving at the rear propeller, which water jet, due to the action of the front propeller, has a contracted cross section, is designed to optimize the jet energy exiting the front propeller; and (k) said rear propeller further having an annular area extending from said central portion to the outer circumference of the rear propeller, which is designed with the same design as that characterizing the front propeller, said annular area of the rear propeller interacting with surrounding ambient water.

2. The combination in accordance with claim 1, wherein the pitch of the blades in the central portion of the rear propeller is 1.04 to 1.52 times the pitch of the blades in an equivalent central portion of the front propeller.

3. The combination in accordance with claim 2, wherein the pitch of the blades in the annular area of the rear propeller is between 95 percent and 105 percent of the pitch of the blades of the front propeller.

4. The combination in accordance with claim 1 wherein the pitches of the blades of each of the front and rear propellers is in the range of 0.9 to 1.6.

5. The combination in accordance with claim 4, wherein blades of the front and rear propellers have different degrees of arcing.

6. The combination in accordance with claim 1, wherein said guide blades have an arc length ratio in the range of 0.0 to 0.2 and an angle of incidence in the range of −7 to +7.

7. The combination in accordance with claim 1, wherein the control means includes two guide blades which are angularly symmetrically disposed about the common axis of rotation of the front and rear propellers.

8. The combination in accordance with claim 1, wherein the watercraft drive further comprises a transmission, said at least one drive shaft extending from opposite ends thereof, and a connection shaft extending from said transmission through said hollow shaft into said hull for connection to a prime mover disposed therein.

9. The combination in accordance with claim 1, wherein said watercraft drive includes an electric motor, and a plurality of electrical conductors extending from said motor through said hollow shaft into said hull for connection to a source of electrical power therein.

10. The combination in accordance with claim 1, further comprising a hydraulic motor mounted in said watercraft operatively connected to hydraulic fluid lines extending through said hollow shaft into said hull for connection to a source of hydraulic power.

11. The combination in accordance with claim 1, further comprising an accelerating nozzle jacketing the front propeller, said accelerating nozzle having a cross section which tapers from an inlet end upstream of the front propeller to a plane of rotation of the front propeller.

12. The combination in accordance with claim 1, wherein each of said front and rear propellers is jacketed by a decelerating nozzle having a cross section which increases from a respective nozzle inlet to a plane of rotation of the respective propeller.

13. The combination in accordance with claim 1, wherein the upper end of the hollow shaft is rotatably mounted on the hull for enabling rotation of the underwater housing relative to the hull.

14. The combination in accordance with claim 13, wherein the hollow shaft is rotatable by 360 degrees about a longitudinal axis relative to the hull.

15. The combination in accordance with claim 1 further comprising a front hub for fastening the front propeller to its respective drive shaft and a rear hub for fastening the rear propeller to its respective drive shaft, the front hub and the rear hub being contoured for enhancing flow from the front propeller to the rear propeller.

16. The combination in accordance with claim 9, wherein the motor is a permanently excited synchronous electric motor.

17. The combination in accordance with claim 16, further comprising a clutch connecting said at least one driving shaft to the motor rotor, said at least one driving shaft passing concentrically through the rotor and extending from both ends of the rotor for receiving the propellers which rotate in unison with said at least one driving shaft.

18. The combination in accordance with claim 17, further comprising a bearing operatively mounted between said housing and said rotor for enabling relative rotation.

19. The combination in accordance with claim 17, further comprising a rotor support tube for coupling said at least one drive shaft and the motor rotor.

20. The combination in accordance with claim 13, wherein the axis of the hollow shaft intersects and is orthogonal to the axis of the at least one drive shaft, and further said combination comprises a carrier cone to which the upper end of the hollow shaft is connected, the housing being continuously pivotable by 360 degrees around the longitudinal axis of the hollow shaft.

21. The combination in accordance with claim 20, wherein the hollow shaft and the carrier cone are mutually detachably connected in a plane of the hull.

22. The combination in accordance with claim 20, wherein the carrier cone has a large end and a small end having a smaller cross section than that of said large end, the hollow shaft being connected to the small end of the carrier cone and the large end of the carrier cone being connected to the watercraft within the hull.

23. The combination in accordance with claim 7, wherein the hollow shaft comprises one of said guide blades that are rotationally symmetrical disposed about the common axis of rotation of the front and rear propellers.

24. The combination in accordance with claim 1, wherein the front propeller is jacketed by a decelerating nozzle having an inlet and a cross section which increases from the inlet to the plane of rotation of the propeller.

25. The combination in accordance with claim 1, wherein each of the front and rear propellers is jacketed by one of an accelerating nozzle having an inlet and a cross section that decreases with distance from its inlet to the plane of rotation of its respective propeller, and a decelerating nozzle having an inlet and a cross section that increases from its inlet to the plane of rotation of its respective propeller.

26. The combination in accordance with claim 9, wherein said electric motor has a rotor and a stator; a first support tube is in heat conducting relationship to said rotor; a second support tube having an inner surface and an outer surface is arranged with its inner surface in heat conducting relationship to said stator and its outer surface in heat conducting relationship to said underwater housing, whereby heat from said rotor and stator is conducted to ambient water surrounding said underwater housing for cooling said motor.

* * * * *